US010025210B2

(12) United States Patent
Tanabe et al.

(10) Patent No.: US 10,025,210 B2
(45) Date of Patent: Jul. 17, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Takeshi Tanabe, Kanagawa (JP); Sakon Takahashi, Kanagawa (JP); Yasuaki Hashimoto, Kanagawa (JP); Masaaki Usami, Kanagawa (JP); Yuka Zenitani, Kanagawa (JP); Hiroshi Kamada, Kanagawa (JP); Moegi Iguchi, Kanagawa (JP); Yuta Saeki, Kanagawa (JP); Hiroaki Saijo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/344,414

(22) Filed: Nov. 4, 2016

(65) Prior Publication Data

US 2017/0315460 A1 Nov. 2, 2017

(30) Foreign Application Priority Data

Apr. 28, 2016 (JP) ..... 2016-091702

(51) Int. Cl.
*G03G 9/097* (2006.01)
*G03G 9/08* (2006.01)
(Continued)

(52) U.S. Cl.
CPC ..... *G03G 9/0819* (2013.01); *G03G 9/0827* (2013.01); *G03G 9/0872* (2013.01);
(Continued)

(58) Field of Classification Search
CPC ..... G03G 9/09725; G03G 9/09766; G03G 9/09791; G03G 9/08755
See application file for complete search history.

(56) References Cited

U.S. PATENT DOCUMENTS

2007/0020541 A1* 1/2007 Hasegawa ..... G03G 9/0804 430/106.1
2010/0196817 A1* 8/2010 Sasaki ..... G03G 9/0819 430/109.4
(Continued)

FOREIGN PATENT DOCUMENTS

JP 2003-215837 * 7/2003 ..... G03G 9/08
JP 2009-128778 * 6/2009 ..... G03G 9/08
(Continued)

OTHER PUBLICATIONS

Translation of JP 2009-128778 pulbished Jun. 2009.*
Translation of JP 2003-215837 published Jul. 2003.*

*Primary Examiner* — Peter L Vajda
(74) *Attorney, Agent, or Firm* — Oliff PLC

(57) ABSTRACT

An electrostatic charge image developing toner includes toner particles, silica particles having an average particle diameter of 80 nm to 200 nm, lubricant particles N which has negatively chargeable property, and lubricant particles P which has positively chargeable property, wherein a content (s) of the silica particles, a content (n) of the lubricant particles N, and a content (p) of the lubricant particles P satisfy relationships of Expression (1): $0.002 \leq p/s \leq 0.2$; and Expression (2): $0.02 \leq n/s \leq 0.5$.

16 Claims, 2 Drawing Sheets

(51) Int. Cl.

| | |
|---|---|
| ***G03G 9/087*** | (2006.01) |
| ***G03G 9/09*** | (2006.01) |
| ***G03G 9/107*** | (2006.01) |
| ***G03G 9/113*** | (2006.01) |
| ***G03G 15/08*** | (2006.01) |

(52) U.S. Cl.
CPC ..... *G03G 9/08755* (2013.01); *G03G 9/0918* (2013.01); *G03G 9/1075* (2013.01); *G03G 9/1133* (2013.01); *G03G 15/0867* (2013.01)

(56) References Cited

U.S. PATENT DOCUMENTS

| | | | | |
|---|---|---|---|---|
| 2012/0094230 | A1* | 4/2012 | Sakoh ..... | G03G 9/0827<br>430/111.4 |
| 2013/0196261 | A1* | 8/2013 | Uchinokura ..... | G03G 9/08<br>430/105 |
| 2014/0220488 | A1 | 8/2014 | Hosoya et al. | |

FOREIGN PATENT DOCUMENTS

| | | | |
|---|---|---|---|
| JP | 2010-197732 | A | 9/2010 |
| JP | 2011-128218 | A | 6/2011 |
| JP | 2014-153456 | A | 8/2014 |
| JP | 2015-152793 | A | 8/2015 |
| JP | 2016-009097 | A | 1/2016 |

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-091702 filed Apr. 28, 2016.

BACKGROUND

1. Technical Field

The present invention relates to an electrostatic charge image developing toner, an electrostatic charge image developer, and a toner cartridge.

2. Related Art

In the electrophotographic image forming, toners are used as image forming materials, and, for example, a toner including toner particles containing a binder resin and a colorant, and an external additive that is externally added to the toner particles are widely used.

SUMMARY

According to an aspect of the invention, there is provided an electrostatic charge image developing toner including:

toner particles;

silica particles having an average particle diameter of 80 nm to 200 nm;

lubricant particles N which has negatively chargeable property; and lubricant particles P which has positively chargeable property, wherein a content (s) of the silica particles, a content (n) of the lubricant particles N, and a content (p) of the lubricant particles P satisfy relationships of the following Expression (1) and Expression (2):

$$0.002 \leq p/s \leq 0.2; \text{ and} \quad \text{Expression (1):}$$

$$0.02 \leq n/s \leq 0.5. \quad \text{Expression (2):}$$

BRIEF DESCRIPTION OF THE DRAWINGS

Exemplary embodiments of the present invention will be described in detail based on the following figures, wherein.

DETAILED DESCRIPTION

Figure 1:
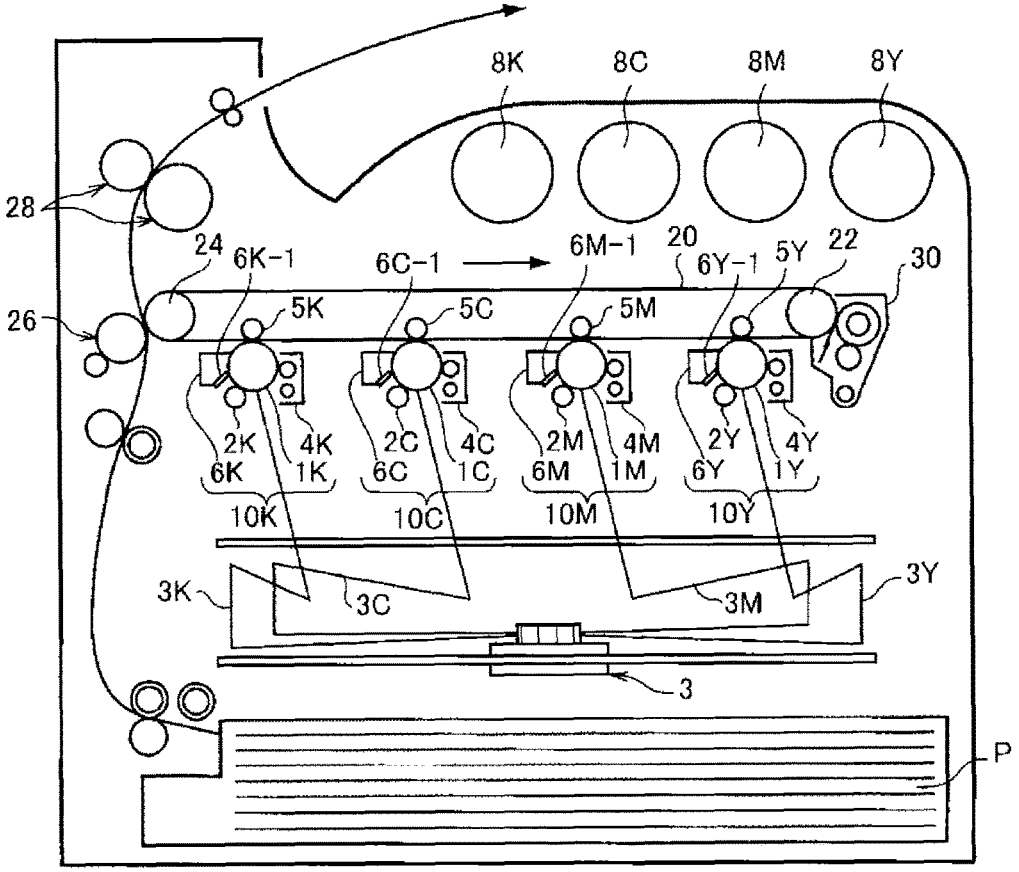
FIG. 1 is a schematic configuration diagram showing an image forming apparatus according to the exemplary embodiment.

Hereinafter, exemplary embodiments which are examples of the invention will be described.

Electrostatic Charge Image Developing Toner

An electrostatic charge image developing toner (hereinafter, also simply referred to as a "toner") according to the exemplary embodiment includes toner particles, silica particles having an average particle diameter of 80 nm to 200 nm, lubricant particles N which has negatively chargeable property, and lubricant particles P which has positively chargeable property.

A content (s) of the silica particles, a content (n) of the lubricant particles N, and a content (p) of the lubricant particles P satisfy relationships of the following Expression (1) and Expression (2).

$$0.002 \leq p/s \leq 0.2 \quad \text{Expression (1):}$$

$$0.02 \leq n/s \leq 0.5 \quad \text{Expression (2):}$$

With the configuration described above, the toner according to the exemplary embodiment prevents formation of image defects occurring on a boundary between an image part and a non-image part of an image (a) that is successively formed, when the same images (a) are successively formed and then a half-tone image (b) different from the image (a) is formed. The reasons thereof are assumed as follows.

In the related art, in the electrophotographic image forming, a cleaning unit using a cleaning blade is used in order to remove an untransferred toner remaining on an image holding member. A process of adding a lubricant into a toner is performed in order to prevent abrasion of an image holding member due to the contact with the cleaning blade. Attachments such as discharge products may be attached to the surface of the image holding member and the process of adding an abrasive into a toner is performed in order to apply a function of scraping these attachments.

However, in a case of using a toner obtained by externally adding lubricant particles and abrasive particles to toner particles, image defects occurring on a boundary between an image part and a non-image part of an image (a) that is successively formed, may be generated, when the same images (a) are successively formed and then a half-tone image (b) different from the image (a) is formed.

As a reason of the formation of image defects occurring in a boundary between an image part and a non-image part, the imparting of charging properties of lubricant particles and abrasive particles is considered. In a case where the toner particles have negatively (minus) chargeable property, for example, and when positively (plus) chargeable particles such as fatty acid metal salt are used as the lubricant particles, a large amount of lubricant particles of the total amount of the lubricant particles supplied to the surface of the image holding member is supplied to a non-image part. When negatively (minus) chargeable particles are used as the lubricant particles, a large amount of lubricant particles thereof is supplied to an image part. As a result, in a case where the same images (a) are successively printed, a difference between a rate of progression of abrasion of the image holding member of the non-image part of the image (a) and a rate of progression of abrasion of the image holding member of the image part thereof occurs, and a difference in level of a film thickness of the image holding member occurs in a boundary of the image part and the non-image part. When the half-tone image (b) different from the image (a) is printed thereafter, image defects may be generated due to the effect of the difference in level occurred in the boundary of the image part and the non-image part of the image (a).

Specific examples of the image defects include occurrence of filming, formation of deletion on a half-tone image, and formation of color streaks, which are due to the abrasion of the surface of the photoreceptor and occurrence of a difference in cleaning properties.

With respect to this, in the toner according to the exemplary embodiment, a ratio of the content of the negatively chargeable lubricant particles N to the content of the silica particles as the abrasive and a ratio of the content of the positively chargeable lubricant particles P thereto are adjusted so as to satisfy the relationships of Expression (1) and Expression (2) and the average particle diameter of the silica particles is controlled to fall in the range described above.

First, in the exemplary embodiment, silica particles are used as an abrasive. An abrasive used in the related art normally has a large particle diameter and different shapes, unlike in a case of the silica particles. Accordingly, the abrasive used in the related art does not only scrape discharge products attached to the surface of the image holding member or a lubricant film, but also remarkably cause acceleration of abrasion of the surface of the image holding member to cause a decrease in maintainability of the image holding member. Even when the amount of the abrasive is decreased in order to decrease the abrasion loss, scratches may be generated on the surface of the image holding member or uneven abrasion due to uneven supply of the abrasive may occur.

With respect to this, the silica particles of the exemplary embodiment have an average particle diameter in the range described above. Unlike in the case of the abrasive in the related art, the silica particles are easily controlled to have substantially even particle diameters and it is possible to control abrasiveness with the particle diameters and the shapes thereof.

In the exemplary embodiment, the silica particles which are an abrasive have a function of removing attachments such as discharge products attached to the surface of the image holding member as described above, and also exhibit a function of scraping a lubricant film formed by drawing the lubricant particles in a film shape on the surface of the image holding member. However, the silica particles are normally negatively charged, and accordingly, in a case where the toner particles are negatively (minus) chargeable, a large amount of the silica particles is supplied to an image part, that is, a function of scraping the lubricant film is further exhibited in the image part. Thus, the ratio of the content of the positively chargeable lubricant particles P to the content of the silica particles is controlled to be in the range satisfying Expression (1) and the ratio of the content of the negatively chargeable lubricant particles N to the content of the silica particles is controlled to be in the range satisfying Expression (2), so as to prevent a difference in film thickness between a lubricant film formed on an image part and a lubricant film formed on a non-image part on the surface of the image holding member.

When particles having a large size with an average particle diameter of 80 nm to 200 nm are used as the silica particles, the isolation of the silica particles from the toner particles is suitably controlled, and the amount of the silica particles supplied to the surface of the image holding member is also controlled to be in a suitable range. As a result, a function of scraping a lubricant film is obtained. From this viewpoint, a difference in film thickness between a lubricant film formed on an image part and a lubricant film formed on a non-image part on the surface of the image holding member is prevented.

Accordingly, even in a case where the same images (a) are successively printed, a difference between a rate of progression of abrasion of the image holding member of the non-image part of the image (a) and a rate of progression of abrasion of the image holding member of the image part thereof is prevented, and a difference in level of a film thickness of the image holding member in a boundary of the image part and the non-image part is decreased. As a result, it is assumed that, even in a case where the images (a) are successively formed and then the half-tone image (b) different from the image (a) is printed, image defects on a boundary between an image part and a non-image part of the image (a) are prevented.

According to the toner according to the exemplary embodiment, even after the same images (a) are successively formed, attachments such as discharge products attached to the surface of the image holding member is prevented on both of the image part and the non-image part of the image (a), and formation of image defects due to the attachment is prevented. The reasons thereof are assumed as follows.

In a case of forming a lubricant film by supplying lubricant particles to the surface of the image holding member, the amount of the lubricant particles supplied may be locally increased to cause an increase in thickness of only some parts (lubricant contamination). Attachments such as discharge products tend to be more easily attached to the lubricant contamination part having an increased thickness, and image defects due to the attachments may be generated.

With respect to this, in the toner according to the exemplary embodiment, with the configuration described above, even in a case where the same images (a) are successively printed as described above, a difference in film thickness between a lubricant film formed on an image part and a lubricant film formed on a non-image part is prevented. In addition, a lubricant film having a suitable film thickness which is not excessively thick, is formed on both of the image part and the non-image part, and an increase in thickness of only some parts (lubricant contamination) is also prevented. As a result, it is assumed that attachments such as discharge products attached to the surface of the image holding member is prevented on both of the image part and the non-image part, and formation of the image defects due to the attachment is prevented.

Average Particle Diameter of Silica Particles

The average particle diameter of the silica particles is 80 nm to 200 nm. The average particle diameter of the silica particles is more preferably 100 nm to 150 nm and even more preferably 110 nm to 130 nm.

When the average particle diameter of the silica particles is equal to or greater than 80 nm, when the same images (a) are successively formed and then the half-tone image (b) different from the image (a) is formed, image defects generated on a boundary between an image part and a non-image part of an image (a) are prevented, and even after the same images (a) are successively formed, formation of image defects due to attachments such as discharge products attached to the surface of the image holding member is also prevented. Meanwhile, when the average particle diameter of the silica particles is equal to or smaller than 200 nm, the amount of the silica particles isolated from the toner particles is not excessively large, and as a result, a function of the silica particles of scraping the lubricant film is suitably controlled and image defects generated on a boundary between the image part and the non-image part are prevented.

A measurement method of the average particle diameter of the silica particles will be described.

Expression (1) and Expression (2)

The content (s) of the silica particles, the content (n) of the lubricant particles N, and the content (p) of the lubricant particles P satisfy relationships of the following Expression (1) and Expression (2).

$$0.002 \leq p/s \leq 0.2 \quad \text{Expression (1):}$$

$$0.02 \leq n/s \leq 0.5 \quad \text{Expression (2):}$$

When the relationships of Expression (1) and Expression (2) are satisfied, even in a case where the same images (a) are successively printed, a difference in level of a film thickness of the image holding member in a boundary of the image part and the non-image part of the image (a) is decreased. As a result, even in a case where the images (a) are successively formed and then the half-tone image (b) different from the image (a) is printed, image defects on a boundary between an image part and a non-image part of the image (a) are prevented.

The relationships between the content (s) of the silica particles, the content (n) of the lubricant particles N, and the content (p) of the lubricant particles P more preferably satisfy relationships of the following Expression (1-1) and Expression (2-1) and even more preferably satisfy relationships of the following Expression (1-2) and Expression (2-2).

$$0.005 \leq p/s \leq 0.050 \quad \text{Expression (1-1):}$$

$$0.02 \leq n/s \leq 0.40 \quad \text{Expression (2-1):}$$

$$0.005 \leq p/s \leq 0.020 \quad \text{Expression (1-2):}$$

$$0.05 \leq n/s \leq 0.30 \quad \text{Expression (2-2):}$$

Measurement of each of the content (s) of the silica particles, the content (p) of the lubricant particles P, and the content (n) of the lubricant particles N, in the toner is performed by the following method.

The content of the silica particles may be measured by fluorescent X-ray measurement. In a case where the silica particles having an average particle diameter which is not in a range of 80 nm to 200 nm are included, silica particles are specified by SEM-EDX (Energy Dispersive X-ray Spectroscopy), a particle size distribution is determined by performing image treatment of the specified silica particles, and correction of a fluorescent X-ray dose due to a difference in particle diameter of silica particles is performed from a proportion of silica particles having a particle diameter of 80 nm to 200 nm determined from the particle size distribution and the content of the total silica particles measured by the fluorescent X-ray measurement, and accordingly, the content of the silica particles may be determined.

In a case of fatty acid metal salt, for example, the content of the lubricant particles P may be measured by quantifying the metal salt by fluorescent X-ray measurement. In a case of zinc stearate, the content of Zn is measured.

In a case of fluororesin particles, for example, the content of the lubricant particles N may be measured by quantifying F by fluorescent X-ray measurement.

Hereinafter, the toner according to the exemplary embodiment will be described in detail.

The toner according to the exemplary embodiment includes toner particles and an external additive.

Toner Particles

The toner particles include a binder resin. The toner particles may include a colorant, a release agent, and other additives, if necessary.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used alone or in combination of two or more kinds thereof.

As the binder resin, a polyester resin is suitable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

It is preferable that a compositional monomer of the polyester resin includes neopentyl glycol.

The glass transition temperature (Tg) of the polyester resin is preferably 50° C. to 80° C., and more preferably 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K 7121-1987 "Testing Methods for Transition Temperature of Plastics".

The weight average molecular weight (Mw) of the polyester resin is preferably 5,000 to 1,000,000 and more preferably 7,000 to 500,000.

The number average molecular weight (Mn) of the polyester resin is preferably 2,000 to 100,000.

The molecular weight distribution Mw/Mn of the polyester resin is preferably 1.5 to 100 and more preferably 2 to 60.

The weight average molecular weight and the number average molecular weight are measured by gel permeation chromatography (GPC). The molecular weight measurement by GPC is performed by using GPC•HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably 40% by weight to 95% by weight, more preferably 50% by weight to 90% by weight, and even more preferably 60% by weight to 85% by weight with respect to a total amount of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is, for example, preferably 1% by weight to 30% by weight, more preferably 3% by weight to 15% by weight with respect to a total amount of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core part (core particle) and a coating layer (shell layer) coated on the core part.

The toner particles having a core/shell structure is composed of, for example, a core part containing a binder resin, and if necessary, other additives such as a colorant and a release agent and a coating layer containing a binder resin.

The volume average particle diameter (D50v) of the toner particles is preferably 2 μm to 10 μm, and more preferably 4 μm to 8 μm.

Various average particle diameters and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume particle size distribution index (GSDv) is calculated as $(D84v/D16v)^{1/2}$, while a number particle size distribution index (GSDp) is calculated as $(D84p/D16p)^{1/2}$.

A shape factor SF1 of the toner particles is preferably 110 to 150, and more preferably 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner, and A represents a projected area of a toner.

Specifically, the shape factor SF1 is numerically converted mainly by analyzing a microscopic image or a scanning electron microscope (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additives

Silica Particles

The silica particles may be particles using silica, that is, $SiO_2$ as a main component and may be crystalline or amorphous. In addition, the silica particles may be particles prepared by using water glass or a silicon compound such as alkoxysilane as a raw material or may be particles obtained by pulverizing quartz.

Specifically, examples of the silica particles include sol-gel silica particles, water colloidal silica particles, alcoholic silica particles, fumed silica particles obtained by a gas phase method, and fused silica particles. Among these, sol-gel silica particles are preferably used as the silica particles, from a viewpoint of satisfying the following properties.

The silica particles are preferably monodisperse and spherical particles. The monodisperse spherical silica particles are dispersed on the surface of the toner particles substantially in an even state and a stable spacer effect is obtained.

Here, the monodisperse state may be defined by using standard deviation with respect to an average particle diameter in a case of including an aggregate, and the standard deviation is preferably a value obtained by a volume average particle diameter D50×0.22 or smaller. The spherical shape may be defined by using an average circularity which will be described later.

Average Particle Diameter

The average particle diameter (primary particle diameter) of the silica particles is 80 nm to 200 nm and more preferably in the range described above.

Here, the average particle diameter of the silica particles is measured by using the following method.

The primary particles of the silica particles are observed by using a scanning electron microscope (SEM) device (S-4100, manufactured by Hitachi, Ltd.) to capture an image, this image is incorporated in an image analysis device (LUZEX III, manufactured by NIRECO Corporation), an area for each particle is measured by the image analysis of the primary particles, and an equivalent circle diameter is calculated from the area value. The calculation of the equivalent circle diameter is performed regarding 100 silica particles. A diameter (D50) when cumulative frequency of the obtained based on volume of the obtained equivalent circle diameter becomes 50% is set as an average primary particle diameter (average equivalent circle diameter D50) of the silica particles. A magnification of an electron microscope is adjusted so that approximately 10 to 50 silica particles are shown in 1 viewing field and an equivalent circle diameter of the primary particles is determined by combining observation of plural viewing fields with each other.

Average Circularity

An average circularity of the silica particles is preferably 0.75 to 1.0, more preferably 0.9 to 1.0, and even more preferably 0.92 to 0.98.

When the average circularity of the silica particles is equal to or greater than 0.75, silica particles having a shape that is closer to a sphere are obtained, and a function of scraping a lubricant film is not excessively strongly exhibited and is controlled in a suitable range. As a result, even in a case where the same images (a) are successively formed and then the half-tone image (b) different from the image (a) is printed, image defects on a boundary between an image part and a non-image part of the image (a) are prevented. The lubricant contamination is prevented, attachments such as discharge products attached to the surface of the image holding member is prevented, and formation of image defects caused by the attachment is also prevented.

Here, the average circularity of the silica particles is measured by using the following method.

First, the primary particles of the silica particles are observed by using a SEM device and the circularity of the silica particles is obtained as a value of "100/SF2" calculated by the following Expression from the planar image analysis of the obtained primary particles.

$$\text{Circularity}(100/SF2)=4\pi\times(A/I^2) \quad \text{Expression:}$$

[In Expression, I represents a perimeter of primary particles on an image and A represents a projected area of primary particles]

The average circularity of the silica particles is obtained as a circularity of cumulative frequency of circularity of the 100 primary particles obtained by planar image analysis becomes 50%.

Surface Treatment

The surfaces of the silica particles may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, 1 part by weight to 10 parts by weight with respect to 100 parts by weight of the silica particles.

Content

The content of the silica particles with respect to the content of the toner particles is preferably 0.5% by weight to 3.0% by weight, more preferably 1.0% by weight to 2.5% by weight, and even more preferably 1.5% by weight to 2.0% by weight.

When the content of the silica particles is equal to or greater than 0.5% by weight, the amount of the silica particles supplied to a front end of a cleaning portion is easily ensured. When the content of the silica particles is equal to or smaller than 3.0% by weight, the excessive isolation of the silica particles from the toner particles is prevented and excessive scraping of the lubricant film on the surface of the image holding member is prevented.

Lubricant Particles

In the toner according to the exemplary embodiment, the negatively chargeable lubricant particles N and the positively chargeable lubricant particles P are used in combination. Here, the "negatively chargeable" or "positively chargeable" property means that the toner is negatively charged or positively charged, when the toner is charged in a developing device.

As the positively chargeable lubricant particles P, fatty acid metal salt particles are used, for example. The fatty acid metal salt particles are particles of salt formed of fatty acid and metal.

Fatty acid may be any one of saturated fatty acid or unsaturated fatty acid. As the fatty acid, fatty acid having 10 to 25 carbon atoms (preferably 12 to 22 carbon atoms) is used. The carbon number of fatty acid is a value containing the number of carbon atoms of a carboxy group.

Examples of fatty acid include unsaturated fatty acid such as behenic acid, stearic acid, palmitic acid, myristic acid, or lauric acid; or saturated fatty acid such as oleic acid, linoleic acid, or ricinoleic acid. Among these fatty acid, stearic acid and lauric acid are preferable and stearic acid is more preferable.

As the metal, divalent metal may be used. Examples of metal include magnesium, calcium, aluminum, barium, and zinc. Among these, zinc is preferable as the metal.

Examples of fatty acid metal salt particles include particles of metal salt of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, or sodium stearate; metal salt of palmitic acid such as zinc palmitate, cobalt palmitate, copper palmitate, magnesium palmitate, aluminum palmitate, or calcium palmitate; metal salt of lauric acid such as zinc laurate, manganese laurate, calcium laurate, iron laurate, magnesium laurate, or aluminum laurate; metal salt of oleic acid such as zinc oleate, manganese oleate, iron oleate, aluminum oleate, copper oleate, magnesium oleate, or calcium oleate; metal salt of linoleic acid such as zinc linoleate, cobalt linoleate, or calcium linoleate; and metal salt of ricinoleic acid such as zinc ricinoleate or aluminum ricinoleate.

Among the fatty acid metal salt particles, particles of metal salt of stearic acid or metal salt of lauric acid are preferable, particles of zinc stearate or zinc laurate are more preferable, and zinc stearate particles are even more preferable.

Examples of the negatively chargeable lubricant particles N include fluorine resin particles, a silicon resin, inorganic particles, or wax resin particles.

Examples of the fluorine resin particles include particles of polytetrafluoroethylene (PTFE, "tetrafluoroethylene resin"), perfluoroalkoxy fluorine resins, polychlorotrifluoroethylene, polyvinylidene fluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer, a tetrafluoroethylene-hexafluoropropylene-perfluoroalkyl vinyl ether copolymer, and a tetrafluoroethylene-perfluoroalkoxy ethylene copolymer.

Among these, polytetrafluoroethylene (PTFE) is preferable.

Content

In the toner according to the exemplary embodiment, the content of the negatively chargeable lubricant particles N and the content of the positively chargeable lubricant particles P satisfy the relationships of Expression (1) and Expression (2) with respect to the content of the silica particles.

From a viewpoint of the content with respect to the toner particles, the content of the lubricant particles P is preferably 0.001% by weight to 0.5% by weight, more preferably 0.005% by weight to 0.05% by weight, and even more preferably 0.01% by weight to 0.03% by weight.

When the content of the lubricant particles P is equal to or greater than the lower limit value described above, the amount of the lubricant particles P supplied to the non-image part is easily ensured, in a case where the negatively chargeable toner particles are used. When the content of the lubricant particles P is equal to or smaller than the upper limit value described above, the amount of the lubricant particles P supplied to the non-image part is not excessively increased, a difference in film thickness of the lubricant film between the image part and the non-image part is prevented, and an increase in thickness of only some parts (lubricant contamination) is prevented.

From a viewpoint of the content with respect to the toner particles, the content of the lubricant particles N is preferably 0.05% by weight to 0.5% by weight, more preferably 0.10% by weight to 0.40% by weight, and even more preferably 0.15% by weight to 0.30% by weight.

When the content of the lubricant particles N is equal to or greater than the lower limit value described above, the amount of the lubricant particles N supplied to the image part is easily ensured, in a case where the negatively chargeable toner particles are used. When the content of the lubricant particles N is equal to or smaller than the upper limit value described above, the amount of the lubricant particles N supplied to the image part is not excessively increased, a difference in film thickness of the lubricant film between the image part and the non-image part is prevented, and an increase in thickness of only some parts (lubricant contamination) is prevented.

Particle Diameter

The average particle diameter of the lubricant particles P is preferably 0.1 μm to 50 μm, more preferably 1 μm to 20 μm, and even more preferably 1 μm to 10 μm.

The average particle diameter of the lubricant particles N is preferably 100 nm to 1,000 nm, more preferably 100 nm to 400 nm, and even more preferably 200 nm to 400 nm.

Here, the average particle diameters of the lubricant particles P and the lubricant particles N are measured by the following method.

The primary particles of the lubricant particles P and the lubricant particles N are observed by using a scanning electron microscope (SEM) device (S-4100 manufactured by Hitachi, Ltd.) to capture an image, the image is incorporated in an image analysis device (LUZEX III manufactured by NIRECO), an area for each particle is measured by the image analysis of the primary particles, and an equivalent circle diameter is calculated from the area value. The calculation of the equivalent circle diameter is performed regarding 100 particles. A diameter (D50) when cumulative frequency of the obtained based on volume of the obtained equivalent circle diameter becomes 50% is set as average primary particle diameters (average equivalent circle diameters D50) of the lubricant particles P and the lubricant particles N. A magnification of an electron microscope is adjusted so that approximately 10 to 50 lubricant particles P and lubricant particles N are shown in 1 viewing field and an equivalent circle diameter of the primary particles is determined by combining observation of plural viewing fields with each other.

Proportion of Isolated Particles in Toner

In the toner according to the exemplary embodiment, when the same images (a) are successively formed and then the half-tone image (b) different from the image (a) is formed, the proportion of respective particles isolated from the toner particles is preferably controlled to be in the following range, from a viewpoint of preventing a difference in film thickness of the image holding member between the image part and the non-image part of the image (a) and a viewpoint of preventing attachments such as discharge products attached to the surface of the image holding member.

Proportion of Isolated Silica Particles

Specifically, the proportion of silica particles isolated from the toner particles is preferably 5% to 50%, more preferably 10% to 30%, and even more preferably 15% to 25%.

When the proportion of the isolated silica particles is in the range described above, the scraping of the lubricant film by using the silica particles is suitably controlled, occurrence of a difference in film thickness of the image holding member between the image part and the non-image part is prevented, and attachments such as discharge products are easily prevented.

A measurement method of the proportion of the silica particles isolated from the toner particles is as follows.

First, 100 ml of ion exchange water and 5.5 ml of 10% by weight toluene×100 aqueous solution (manufactured by Acros Organics) are added to 200 mL of glass bottle, 5 g of a toner is added to the mixed solution, the mixed solution is stirred 30 times and kept for 1 hour or longer.

Then, the mixed solution is stirred 20 times, a dial is set to the output of 30% by using an ultrasonic homogenizer (product name: homogenizer, type VCX750, CV33 manufactured by Sonics & Materials, Inc.) and ultrasonic energy is applied for 1 minute under the following conditions.

vibration time: successively 60 seconds amplitude: set to 20 W (30%)

vibration start temperature: 23±1.5° C.

distance between ultrasonic vibrator and bottom surface of vessel: 10 mm

Then, the mixed solution that has received the ultrasonic energy is subjected to filtration under the reduced pressure by using filter paper (product name: QUALITATIVE FILTERS PAPERS (No. 2, 110 mm) manufactured by Toyo Roshi Kaisha, Ltd.), washed two times using ion exchange water, the isolated silica particles are filtered and removed, and the toner is dried.

The amount of silica particles remaining in the toner after removing the silica particles by the above process (hereinafter, referred to as the amount of silica particles after dispersion) and the amount of silica particles of the toner which is not subjected to the process of removing the silica particles described above (hereinafter, referred to as the amount of silica particles before dispersion) are quantified by a fluorescence X-ray method, and values of the amount of silica particles before dispersion and the amount of silica particles after dispersion are substituted in the following expression.

The value calculated by the following expression is set as a proportion of the isolated silica particles.

proportion of isolated silica particles (%)=[(amount of silica particles before dispersion−amount of silica particles after dispersion)/amount of silica particles before dispersion]×100 Expression:

Proportion of Isolated Lubricant Particles P

The proportion of the lubricant particles P isolated from the toner particles is preferably 5% to 50%, more preferably 5% to 40%, and even more preferably 10% to 30%.

When the proportion of the isolated lubricant particles P is in the range described above, the formation of the lubricant film on the surface of the image holding member with the lubricant particles P is suitably controlled, occurrence of a difference in film thickness of the image holding member between the image part and the non-image part is prevented, and attachments such as discharge products are easily prevented.

The measurement of the proportion of the lubricant particles P isolated from the toner particles is performed by the same method as in the case of the proportion of the isolated silica particles.

Proportion of Isolated Lubricant Particles N

The proportion of the lubricant particles N isolated from the toner particles is preferably 5% to 50%, more preferably 5% to 30%, and even more preferably 5% to 20%.

When the proportion of the isolated lubricant particles N is in the range described above, the formation of the lubricant film on the surface of the image holding member with the lubricant particles N is suitably controlled, occurrence of a difference in film thickness of the image holding member between the image part and the non-image part is prevented, and attachments such as discharge products are easily prevented.

The measurement of the proportion of the lubricant particles N isolated from the toner particles is performed by the same method as in the case of the proportion of the isolated silica particles.

The proportions of respective particles isolated from the toner particles are controlled, for example, by adjusting a material or a particle diameter of the toner particles, a material or a particle diameter of the respective particles, the conditions of external adding when externally adding the respective particles to the surface of the toner particles, and the like. Particularly, by adjusting the stirring speed and the stirring time when adding respective particles (silica particles, lubricant particles N, and lubricant particles P) into the toner particles and stirring and controlling the temperature of the mixture at the time of stirring, the proportions of the isolated silica particles, lubricant particles N, and lubricant particles P may be controlled to be in the ranges described above, respectively. When changing only the amount of the target external additive isolated, a multi-stage blending method or a method of previously cracking an external additive alone and externally adding the external additive to the toner particles together with other external additives is used.

Charging Series of Particles in Toner

In the exemplary embodiment, the charging series of the toner particles, the silica particles, the lubricant particles P, and the lubricant particles N contained in the toner (relationship of positive and negative charging and relationship of magnitude of charging) preferably satisfies the following relationship by using the toner particles as a reference.

(positive charging) "lubricant particles *P*">"toner particles>"silica particles and lubricant particles *N*" (negative charging)

In the exemplary embodiment, the measurement of the charging series of the toner particles, the silica particles, the lubricant particles P, and the lubricant particles N is performed by a method based on Standard of The Imaging Society of Japan, toner electrification quantity measuring method (blow off method), by using four types of reference carriers of The Imaging Society of Japan. Specifically, the measurement is performed as follows.

Fluorine resins as carriers for positive charging are mixed with each other to set two types of carrier of P-01 and P-02 coated with the resin and set two types of carrier of N-01 and N-02 coated with an acrylic resin as carriers for negative charging. 10 g of each carrier and 0.5 g of particles (that is, one kind of particles of toner particles, silica particles, lubricant particles P, and lubricant particles N) are mixed with each other to set an electrification quantity, a value on a Y axis at the time of X=0 is regulated as the charging series (reference charging ability) by using a zero charging method.

Other External Additives

As other external additives, inorganic particles other than the silica particles having an average particle diameter of 80 nm to 200 nm and the lubricant particles are used.

Examples of the external additives include $SiO_2$, $TiO_2$, CuO, $SnO_2$, $Fe_2O_3$, BaO, CaO, $K_2O$, $Na_2O$, $CaO.SiO_2$, $K_2O.(TiO_2)n$, $Al_2O_3.2SiO_2$, $MgCO_3$, $BaSO_4$, and $MgSO_4$.

The surfaces of the other inorganic particles may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, 1 part by weight to 10 parts by weight with respect to 100 parts by weight of the other inorganic particles.

The amount (content) of the other external additives externally added is, for example, preferably 0.5% by weight to 5.0% by weight and more preferably 2.0% by weight to 3.0% by weight with respect to the toner particles.

Preparing Method of Toner

Next, a preparing method of the toner according to the exemplary embodiment will be described.

The toner according to the exemplary embodiment is obtained by externally adding an external additive to toner particles, if necessary, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably 0.01 parts by weight to 5.0 parts by weight, and more preferably 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, and freeze drying, flush drying, fluidized drying, vibration-type fluidized drying, or the like may be performed from a viewpoint of productivity.

Then, the toner according to the exemplary embodiment may be prepared by adding an external additive to the obtained dry toner particles and mixing the materials. The mixing may be performed by using a V blender, a HENSCHEL MIXER, a LÖDIGE mixer, and the like. Further, if necessary, coarse toner particles may be removed by using a vibration classifier, a wind classifier, and the like.

Electrostatic Charge Image Developer

An electrostatic charge image developer according to the exemplary embodiment contains at least the toner according to the exemplary embodiment.

The electrostatic charge image developer according to the exemplary embodiment may be a two-component developer containing only the toner according to the exemplary embodiment or may be a two-component developer obtained by mixing the toner and a carrier.

The carrier is not particularly limited and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member to a surface of a recording medium, a cleaning unit that includes a cleaning blade that cleans the surface of the image holding member, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including the processes of: charging a surface of an image holding member; forming an electrostatic charge image on the charged surface of the image holding member; developing the electrostatic charge image formed on the surface of the image holding member with the electrostatic charge image developer according to the exemplary embodiment as a toner image; transferring the toner image formed on the surface of the image holding member to a surface of a recording medium; cleaning the surface of the image holding member with a cleaning blade; and fixing the toner image transferred onto the surface of the recording medium is performed.

As the image forming apparatus according to the exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; or an apparatus that is provided with an erasing unit that irradiates, after transfer of a toner image, a surface of an image holding member with erase light before charging for erasing.

In a case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that accommodates the electrostatic charge image developer according to the exemplary embodiment and is provided with a developing unit is suitably used.

Hereinafter, an example of the image forming apparatus according to the exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting with the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that includes a cleaning blade 6Y-1 that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, so that an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting with the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, the process cartridge is not limited thereto. Major parts shown in the drawing will be described, but descriptions of other parts will be omitted.

Figure 2:
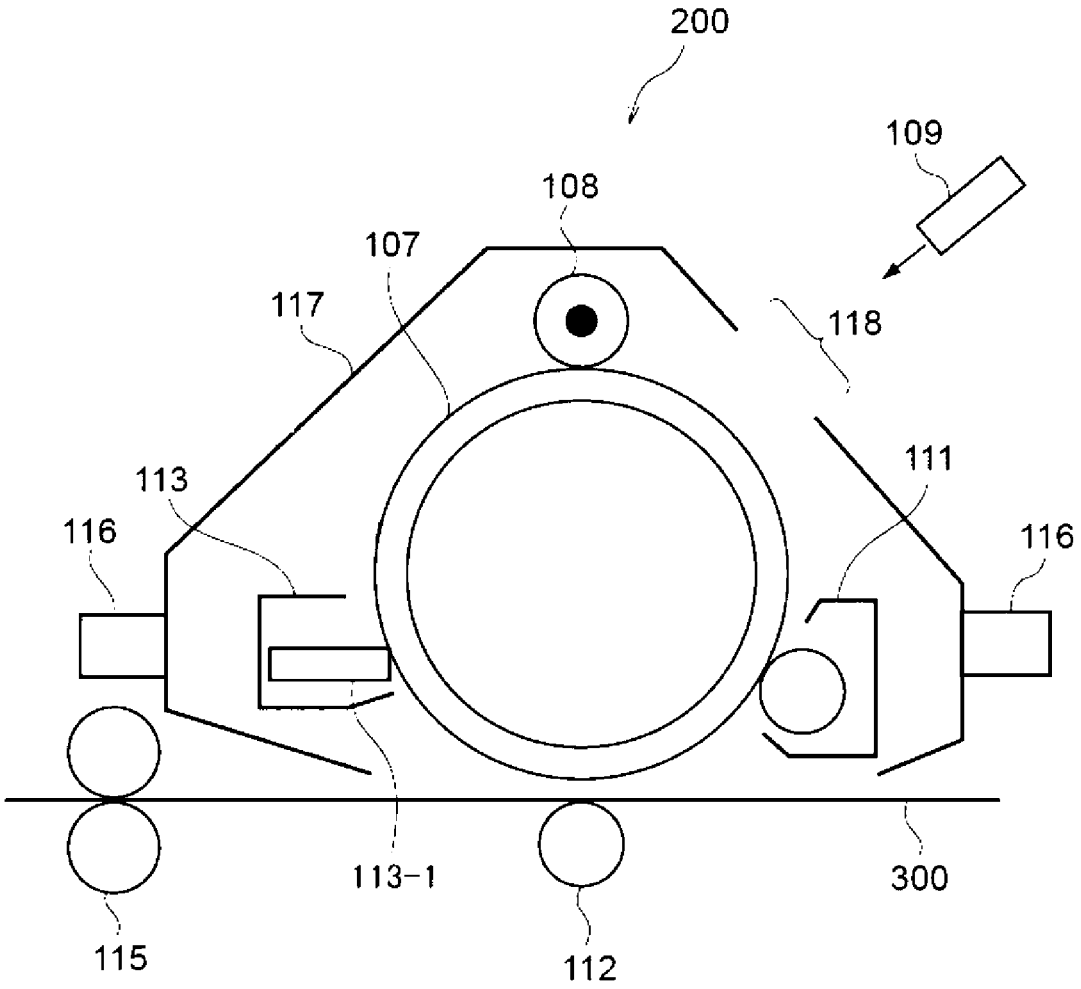
FIG. 2 is a schematic configuration diagram showing a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) that includes a cleaning blade 113-1, which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge accommodates a toner for replenishment for being supplied to the developing unit provided in the image forming apparatus. The toner cartridge may have a container that contains the electrostatic charge image developing toner according to the exemplary embodiment.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

The exemplary embodiments will be described more specifically with reference to examples and comparative examples, but the exemplary embodiments are not limited to the following examples. Unless specifically noted, "parts" and "%" represent "parts by weight" and "% by weight".

Examples 1

Preparation of Toner Particles

Toner Particles (1)

Preparation of Polyester Resin Dispersion

Ethylene glycol (manufactured by Wako Pure Chemical Industries, Ltd.): 37 parts

Neopentyl glycol (manufactured by Wako Pure Chemical Industries, Ltd.): 65 parts 1,9 nonanediol (manufactured by Wako Pure Chemical Industries, Ltd.): 32 parts Terephthalic acid (manufactured by Wako Pure Chemical Industries, Ltd.): 96 parts The above monomers are put into a flask, heated to a temperature of 200° C. for 1 hours, and after confirming that a reaction system is stirred, and 1.2 parts of dibutyl tin oxide is put thereto. The temperature is increased from the temperature described above to 240° C. for 6 hours while distilling away generated water, and a dehydration condensation reaction is further continued at 240° C. for 4 hours, to obtain a polyester resin A having an acid value of 9.4 mgKOH/g, an weight average molecule weight of 13,000, and a glass transition temperature of 62° C.

Then, the polyester resin A as in a melted state is transferred to CAVITRON CD1010 (manufactured by Eurotec Ltd.) at a rate of 100 parts per minute. A diluted ammonia water having concentration of 0.37% obtained by diluting reagent ammonia water with ion exchange water is put into an aqueous medium tank which is separately prepared, and is transferred to CAVITRON described above at the same time as the polyester resin melted material at a rate of 0.1 liters per min, while heating a heat exchanger at 120° C. CAVITRON is operated under the conditions of a rotation rate of a rotor of 60 Hz and pressure of 5 kg/cm$^2$, and an amorphous polyester resin dispersion in which resin particles having a volume average particle diameter of 160 nm, a solid content of 30%, a glass transition temperature of 62° C., and a weight average molecular weight Mw of 13,000 are dispersed is obtained.

Preparation of Colorant Particle Dispersion

Cyan pigment (PIGMENT BLUE 15:3 manufactured by Dainichiseika Color & Chemicals Mfg. Co., Ltd.): 10 parts Anionic surfactant (NEOGEN SC manufactured by DKS Co., Ltd.): 2 parts Ion exchange water: 80 parts The above components are mixed with each other, and dispersed by using a high pressure impact type dispersing machine ULTIMIZER (HJP30006 manufactured by SUGINO MACHINE LIMITED) for 1 hour, and a colorant particle dispersion having a volume average particle diameter of 180 nm and a solid content of 20% is obtained.

Preparation of Release Agent Particle Dispersion

Paraffin Wax (HNP 9 manufactured by Nippon Seiro Co., Ltd.): 50 parts

Anionic surfactant (NEOGEN SC manufactured by DKS Co., Ltd.): 2 parts

Ion exchange water: 200 parts

The above components is heated to 120° C., and sufficiently mixed with each other and dispersed using ULTRA TURRAX T50 manufactured by IKA Works, Inc. The mixture is dispersed using a pressure discharge type homogenizer and a release agent particle dispersion having a volume average particle diameter of 200 nm and solid content of 20% is obtained.

Preparation of Toner Particles (1)

Polyester resin particle dispersion: 200 parts

Colorant particle dispersion: 25 parts

Release agent particle dispersion: 30 parts

Polyaluminum chloride: 0.4 parts

Ion exchange water: 100 parts

The above components are put in a stainless steel flask, sufficiently mixed with each other and dispersed by using ULTRA TURRAX manufactured by IKA Works, Inc. Then, the mixture is heated to 45° C. while stirring the components in the flask in a heating oil bath. After maintaining the mixture at 45° C. for 15 minutes, 70 parts of the same polyester resin dispersion as described above is gently added thereto.

Then, after adjusting the pH in the system to 8.0 using a sodium hydroxide solution having concentration of 0.5 mol/L, the stainless steel flask is sealed, a seal of a stirring shaft is magnetically sealed, and the temperature is increased to 90° C. while continuing stirring and maintained for 3 hours. After the reaction ends, the mixture is cooled at a rate of temperature decrease of 2° C./min, filtered, and sufficiently washed with ion exchange water, and a solid-liquid separation is performed by Nutsche-type suction filtration. In addition, the solid content is dispersed again using 3 L of ion exchange water at 30° C., stirred and washed at 300 rpm for 15 minutes. The washing operation is further repeated six times. When the pH of the filtrate is 7.54 and electrical conductivity is 6.5 μS/cm, the solid-liquid separation is performed by Nutsche-type suction filtration using No. 5A filter paper. Next, vacuum drying is continued for 12 hours and toner particles (1) are obtained.

A volume average particle diameter (D50v) of the toner particles (1) is 5.8 μm and SF1 is 130.

Preparation of External Additives

Preparation of Silica Particles

Preparation of Silica Particle Dispersion (S1)

320 parts of methanol and 72 parts of 10% ammonia water are added into a 1.5 L glass reaction vessel including a stirrer, a dripping nozzle, and a thermometer and mixed with each other to obtain an alkali catalyst solution.

After adjusting the temperature of the alkali catalyst solution to 30° C., 185 parts of tetramethoxysilane (TMOS) and 50 parts of 8.0% ammonia water are added dropwise to the alkali catalyst solution at the same time while being stirred, to obtain a hydrophilic silica particle dispersion (concentration of solid content of 12.0%). Here, the drop time is 30 minutes.

After that, the obtained silica particle dispersion is concentrated by using a rotary filter R-FINE (manufactured by Kotobuki Industries Co., Ltd.) to have a concentration of solid contents of 40%. The concentrated material is set as a silica particle dispersion (S1).

The amount of trimethylsilane which is 20% by weight to the solid content of the silica particles is added to 250 parts of the silica particle dispersion (S1) as a hydrophobizing agent to allow a reaction at 150° C. for 2 hours, the resultant material is cooled and dried by spray drying, and hydrophobic silica particles (S1) in which surfaces of silica particles are treated with the hydrophobizing agent are obtained.

Preparation of Silica Particle Dispersions (S2 to S7)

Silica particles (S2 to S7) are prepared under the same conditions as in the preparing method of the silica particles S1, except for adjusting the amount of methanol, the amount of 10% ammonia water, the amount of tetramethoxysilane (TMOS), the amount of 8% ammonia water, and drop time.

The preparing conditions of the silica particles (S1 to S7), and the average particle diameter and the average circularity of the obtained silica particles are shown in the following Table 1.

TABLE 1

| | Incorporated | | Added dropwise | | | | |
|---|---|---|---|---|---|---|---|
| | Methanol (g) | 10% ammonia water (g) | TMOS (g) | 8% ammonia water (g) | Time (min) | Average particle diameter (nm) | Circularity |
| S1 | 320 | 72 | 185 | 50 | 30 | 120 | 0.97 |
| S2 | 320 | 72 | 50 | 15 | 6 | 85 | 0.97 |
| S3 | 320 | 72 | 750 | 220 | 134 | 190 | 0.97 |
| S4 | 280 | 45 | 185 | 50 | 30 | 120 | 0.76 |
| S5 | 250 | 30 | 185 | 50 | 30 | 120 | 0.68 |
| S6 | 320 | 72 | 45 | 9 | 10 | 50 | 0.91 |
| S7 | 320 | 72 | 800 | 240 | 156 | 230 | 0.98 |

Lubricant Particles N and Lubricant Particles P

PTFE particles (product name: "LUBRON L2" (manufactured by Daikin Industries, Ltd.), average primary particle diameter=300 nm) are prepared as the lubricant particles N.

Fatty acid metal salt particles (zinc stearate particles, product name "SZ-2000" (manufactured by Sakai Chemical Industry Co., Ltd.), average particle diameter=3 μm) are prepared as the lubricant particles P.

Charging Series of Silica Particles, PTFE Particles, and Fatty Acid Metal Salt Particles The charging series is measured by the above-mentioned method based on Standard of The Imaging Society of Japan, Toner electrification quantity measuring method (blow off method), by using four types of reference carriers of The Imaging Society of Japan. That is, 0.5 g of the silica particles, PTFE particles, or fatty acid metal salt particles is put to 10 g of a carrier and the measurement is performed.

The electrification quantity of the silica particles is −100 to −150 (μC/g), the electrification quantity of the PTFE particles is −50 (μC/g), and the electrification quantity of the fatty acid metal salt particles is +80 (μC/g), with respect to the toner particles.

Preparation of Toner and Developer 2.0 parts of the silica particles (S1), 0.02 parts of the lubricant particles P (fatty acid metal salt particles), and 0.2 parts of the lubricant particles N (PTFE particles) are added to 100 parts of the toner particles (1) and mixed with each other with a HENSCHEL MIXER at a stirring rate of 30 m/sec for 15 minutes to obtain a toner.

The obtained toner and a carrier are put into a V blender at a ratio of toner:carrier=5:95 (ratio of weights) and stirred for 20 minutes, to obtain a developer.

As the carrier, a carrier prepared as follows is used.

Ferrite particles (volume average particle diameter of 50 μm): 100 parts

Toluene: 14 parts

A styrene-methyl methacrylate copolymer: 2 parts (component ratio: 90/10, Mw=80,000)

Carbon black (R330 manufactured by Cabot Corporation): 0.2 parts

First, the above components excluding the ferrite particles are stirred by a stirrer for 10 minutes to prepare a dispersed coating solution, the coating solution and the ferrite particles are put into a vacuum degassing type kneader, stirred at 60° C. for 30 minutes, degassed under the reduced pressure while heating, and dried to obtain a carrier.

Example 2

A toner and a developer are obtained in the same manner as in Example 1, except for changing the silica particles to the silica particles (S2) having an average particle diameter shown in the following Table 2.

Example 3

A toner and a developer are obtained in the same manner as in Example 1, except for changing the silica particles to the silica particles (S3) having an average particle diameter shown in the following Table 2.

Example 4

A toner and a developer are obtained in the same manner as in Example 1, except for changing the stirring rate and the stirring time of the HENSCHEL MIXER to 50 m/sec and 15 minutes to change the particles to the silica particles, the lubricant particles P, and the lubricant particles N having values of the proportion of isolation from the toner particles shown in the following Table 2.

Example 5

A toner and a developer are obtained in the same manner as in Example 1, except for changing the stirring rate and the stirring time of the HENSCHEL MIXER to 50 m/sec and 30 minutes to change the particles to the silica particles, the lubricant particles P, and the lubricant particles N having values of the proportion of isolation from the toner particles shown in the following Table 2.

Example 6

A toner and a developer are obtained in the same manner as in Example 1, except for changing the stirring rate and the stirring time of the HENSCHEL MIXER to 20 m/sec and 15 minutes to change the particles to the silica particles, the lubricant particles P, and the lubricant particles N having values of the proportion of isolation from the toner particles shown in the following Table 2.

Example 7

A toner and a developer are obtained in the same manner as in Example 1, except for changing the stirring rate and the stirring time of the HENSCHEL MIXER to 20 m/sec and 10 minutes to change the particles to the silica particles, the lubricant particles P, and the lubricant particles N having values of the proportion of isolation from the toner particles shown in the following Table 2.

Example 8

A toner and a developer are obtained in the same manner as in Example 1, except for changing the content of the lubricant particles P to 0.005 parts (0.005% by weight with respect to the toner particles).

Example 9

A toner and a developer are obtained in the same manner as in Example 1, except for changing the content of the lubricant particles P to 0.4 parts (0.4% by weight with respect to the toner particles).

Example 10

A toner and a developer are obtained in the same manner as in Example 1, except for changing the content of the lubricant particles N to 0.05 parts (0.05% by weight with respect to the toner particles).

Example 11

A toner and a developer are obtained in the same manner as in Example 1, except for changing the content of the lubricant particles N to 1.0 part (1.0% by weight with respect to the toner particles).

Example 12

A toner and a developer are obtained in the same manner as in Example 1, except for changing the content of the lubricant particles P to 0.005 parts (0.005% by weight with respect to the toner particles) and the content of the lubricant particles N to 1.0 part (1.0% by weight with respect to the toner particles).

Example 13

A toner and a developer are obtained in the same manner as in Example 1, except for changing the content of the lubricant particles P to 0.35 parts (0.35% by weight with respect to the toner particles) and the content of the lubricant particles N to 0.05 parts (0.05% by weight with respect to the toner particles).

Example 14

A toner and a developer are obtained in the same manner as in Example 1, except for changing the content of the silica particles to 0.5 parts (0.5% by weight with respect to the toner particles), the content of the lubricant particles P to 0.001 parts (0.001% by weight with respect to the toner particles), and the content of the lubricant particles N to 0.01 parts (0.01% by weight with respect to the toner particles).

Example 15

A toner and a developer are obtained in the same manner as in Example 1, except for changing the content of the silica particles to 0.5 parts (0.5% by weight with respect to the toner particles), the content of the lubricant particles P to 0.1 parts (0.1% by weight with respect to the toner particles), and the content of the lubricant particles N to 0.25 parts (0.25% by weight with respect to the toner particles).

Example 16

A toner and a developer are obtained in the same manner as in Example 1, except for changing the content of the silica particles to 3.0 parts (3.0% by weight with respect to the toner particles), the content of the lubricant particles P to 0.006 parts (0.006% by weight with respect to the toner particles), and the content of the lubricant particles N to 0.06 parts (0.06% by weight with respect to the toner particles).

Example 17

A toner and a developer are obtained in the same manner as in Example 1, except for changing the content of the silica particles to 3.0 parts (3.0% by weight with respect to the toner particles), the content of the lubricant particles P to 0.5 parts (0.5% by weight with respect to the toner particles), and the content of the lubricant particles N to 0.5 parts (0.5% by weight with respect to the toner particles).

Example 18

A toner and a developer are obtained in the same manner as in Example 1, except for changing the silica particles to the silica particles (S4) having an average circularity shown in the following Table 2.

Example 19

A toner and a developer are obtained in the same manner as in Example 1, except for changing the silica particles to the silica particles (S5) having an average circularity shown in the following Table 2.

Example 20

A toner and a developer are obtained in the same manner as in Example 1, except for changing the lubricant particles P of Example 1 to zinc laurate particles ($C_{24}H_{46}O_4Zn$ manufactured by Wako Pure Chemical Industries, Ltd.).

Example 21

A toner and a developer are obtained in the same manner as in Example 1, except for changing the lubricant particles N of Example 1 to calcium fluoride particles ($CaF_2$) manufactured by Stella Chemifa Corporation).

Comparative Example 1

A toner and a developer are obtained in the same manner as in Example 1, except for changing the silica particles to the silica particles (S6) having an average circularity shown in the following Table 3.

Comparative Example 2

A toner and a developer are obtained in the same manner as in Example 1, except for changing the silica particles to the silica particles (S7) having an average circularity shown in the following Table 3.

Comparative Example 3

A toner and a developer are obtained in the same manner as in Example 1, except for changing the content of the lubricant particles P to 0.002 parts (0.002% by weight with respect to the toner particles).

Comparative Example 4

A toner and a developer are obtained in the same manner as in Example 1, except for changing the content of the lubricant particles P to 0.002 parts (0.002% by weight with respect to the toner particles) and the content of the lubricant particles N to 0.02 parts (0.02% by weight with respect to the toner particles).

Comparative Example 5

A toner and a developer are obtained in the same manner as in Example 1, except for changing the content of the lubricant particles P to 0.6 parts (0.6% by weight with respect to the toner particles).

Comparative Example 6

A toner and a developer are obtained in the same manner as in Example 1, except for changing the content of the lubricant particles P to 0.6 parts (0.6% by weight with respect to the toner particles) and the content of the lubricant particles N to 0.02 parts (0.02% by weight with respect to the toner particles).

Comparative Example 7

A toner and a developer are obtained in the same manner as in Example 1, except for changing the content of the lubricant particles P to 0.6 parts (0.6% by weight with respect to the toner particles) and the content of the lubricant particles N to 1.2 parts (1.2% by weight with respect to the toner particles).

Comparative Example 8

A toner and a developer are obtained in the same manner as in Example 1, except for changing the content of the lubricant particles N to 0.02 parts (0.02% by weight with respect to the toner particles).

Comparative Example 9

A toner and a developer are obtained in the same manner as in Example 1, except for changing the content of the lubricant particles N to 1.2 parts (1.2% by weight with respect to the toner particles).

Comparative Example 10

A toner and a developer are obtained in the same manner as in Example 1, except for changing the content of the silica particles to 0.5 parts (0.5% by weight with respect to the toner particles), the content of the lubricant particles P to 0.0005 parts (0.0005% by weight with respect to the toner particles), and the content of the lubricant particles N to 0.3 parts (0.3% by weight with respect to the toner particles).

TABLE 2

| | | Silica particles | | | | | Lubricant particles P | | | Lubricant particles N | | |
|---|---|---|---|---|---|---|---|---|---|---|---|---|
| | | Particle No. | Particle diameter [nm] | Circularity | Content [% by weight] | Proportion of isolation [%] | Content [% by weight] | Proportion of isolation [%] | p/s | Content [% by weight] | Proportion of isolation [%] | n/s |
| Examples | 1 | S1 | 120 | 0.97 | 2.0 | 27 | 0.020 | 35 | 0.010 | 0.2 | 15 | 0.10 |
| | 2 | S2 | 85 | 0.97 | 2.0 | 30 | 0.020 | 38 | 0.010 | 0.2 | 14 | 0.10 |
| | 3 | S3 | 190 | 0.97 | 2.0 | 25 | 0.020 | 31 | 0.010 | 0.2 | 16 | 0.10 |
| | 4 | S1 | 120 | 0.97 | 2.0 | 10 | 0.020 | 20 | 0.010 | 0.2 | 12 | 0.10 |
| | 5 | S1 | 120 | 0.97 | 2.0 | 2 | 0.020 | 4 | 0.010 | 0.2 | 4 | 0.10 |
| | 6 | S1 | 120 | 0.97 | 2.0 | 47 | 0.020 | 49 | 0.010 | 0.2 | 35 | 0.10 |
| | 7 | S1 | 120 | 0.97 | 2.0 | 59 | 0.020 | 65 | 0.010 | 0.2 | 52 | 0.10 |
| | 8 | S1 | 120 | 0.97 | 2.0 | 27 | 0.005 | 36 | 0.003 | 0.2 | 17 | 0.10 |
| | 9 | S1 | 120 | 0.97 | 2.0 | 26 | 0.4 | 34 | 0.20 | 0.2 | 25 | 0.10 |
| | 10 | S1 | 120 | 0.97 | 2.0 | 28 | 0.020 | 36 | 0.010 | 0.05 | 15 | 0.025 |
| | 11 | S1 | 120 | 0.97 | 2.0 | 27 | 0.020 | 33 | 0.010 | 1.0 | 26 | 0.50 |
| | 12 | S1 | 120 | 0.97 | 2.0 | 26 | 0.005 | 25 | 0.003 | 1.0 | 28 | 0.50 |
| | 13 | S1 | 120 | 0.97 | 2.0 | 27 | 0.350 | 39 | 0.175 | 0.05 | 17 | 0.025 |
| | 14 | S1 | 120 | 0.97 | 0.5 | 28 | 0.001 | 27 | 0.002 | 0.01 | 17 | 0.02 |
| | 15 | S1 | 120 | 0.97 | 0.5 | 26 | 0.1 | 45 | 0.20 | 0.25 | 23 | 0.50 |
| | 16 | S1 | 120 | 0.97 | 3.0 | 28 | 0.006 | 27 | 0.002 | 0.06 | 17 | 0.02 |
| | 17 | S1 | 120 | 0.97 | 3.0 | 26 | 0.5 | 45 | 0.17 | 0.5 | 26 | 0.17 |
| | 18 | S4 | 120 | 0.76 | 2.0 | 19 | 0.02 | 22 | 0.010 | 0.2 | 15 | 0.10 |
| | 19 | S5 | 120 | 0.68 | 2.0 | 17 | 0.02 | 21 | 0.010 | 0.2 | 18 | 0.10 |
| | 20 | S1 | 120 | 0.97 | 2.0 | 27 | (*1)0.02 | 35 | 0.010 | 0.2 | 15 | 0.10 |
| | 21 | S1 | 120 | 0.97 | 2.0 | 27 | 0.02 | 35 | 0.010 | (*2)0.2 | 15 | 0.10 |

TABLE 3

| | | Silica particles | | | | | Lubricant particles P | | | Lubricant particles N | | |
|---|---|---|---|---|---|---|---|---|---|---|---|---|
| | | Particle No. | Particle diameter [nm] | Circularity | Content [% by weight] | Proportion of isolation [%] | Content [% by weight] | Proportion of isolation [%] | p/s | Content [% by weight] | Proportion of isolation [%] | n/s |
| Comparative Examples | 1 | S6 | 50 | 0.91 | 2.0 | 27 | 0.02 | 28 | 0010 | 0.2 | 18 | 0.10 |
| | 2 | S7 | 230 | 0.98 | 2.0 | 25 | 0.02 | 28 | 0010 | 0.2 | 19 | 0.10 |
| | 3 | S1 | 120 | 0.97 | 2.0 | 26 | 0.002 | 29 | 0.001 | 0.2 | 12 | 0.10 |
| | 4 | S1 | 120 | 0.97 | 2.0 | 29 | 0.002 | 21 | 0.001 | 0.02 | 14 | 0.01 |
| | 5 | S1 | 120 | 0.97 | 2.0 | 27 | 0.6 | 29 | 0.30 | 0.2 | 18 | 0.10 |
| | 6 | S1 | 120 | 0.97 | 2.0 | 28 | 0.6 | 43 | 0.30 | 0.02 | 16 | 0.01 |
| | 7 | S1 | 120 | 0.97 | 2.0 | 28 | 0.6 | 42 | 0.30 | 1.2 | 35 | 0.60 |
| | 8 | S1 | 120 | 0.97 | 2.0 | 29 | 0.02 | 25 | 0.010 | 0.02 | 15 | 0.01 |
| | 9 | S1 | 120 | 0.97 | 2.0 | 30 | 0.02 | 28 | 0.010 | 1.2 | 25 | 0.6 |
| | 10 | S1 | 120 | 0.97 | 0.5 | 27 | 00005 | 19 | 0.001 | 0.3 | 15 | 0.6 |

In Table 2, "*1" indicates that "zinc laurate particles ($C_{24}H_{46}O_4Zn$ manufactured by Wako Pure Chemical Industries, Ltd.)" are used as the lubricant particles P.

"*2" indicates that "calcium fluoride ($CaF_2$ manufactured by Stella Chemifa Corporation)" are used as the lubricant particles N.

Evaluation

The developer of each example is included in a developing device of an image forming apparatus that is a "modified apparatus of APEOS PORTIVC5575 (Fuji Xerox Co., Ltd.)". After continuously printing images having an image density of 1% on 20,000 A4-sized sheets by using the image forming apparatus, an image having an image density of 40% is printed on one A4-sized sheet. Then, the following evaluation is performed. Results of the evaluation are shown in Table 4.

Evaluation of Filming of Surface of Photoreceptor

Regarding an image part and a non-image part of an image continuously formed, the filming of a lubricant or a toner formed on the surface of the image holding member is determined by sensory evaluation performed by visual observation. Determination criteria are as follows.

The acceptable levels are levels up to G2.

Evaluation Criteria

G1: no filming is observed.

G2: filming is slightly observed without an effect to image quality.

G3: the level of filming is between levels of G2 and G4 and the effect to image quality starts to appear.

G4: filming is clearly observed on the surface and the effects appear in image quality as color streaks and white streaks.

Image Defects: Evaluation of Defects Due to Difference in Level between Image Part and Non-Image Part The half-tone image which is finally printed is visually observed and a formation state of image defects on the image part and the non-image part is evaluated.

The acceptable levels are levels up to G2.

Evaluation Criteria

G1: no deletion is observed on an image part or a non-image part and there are no problems in image quality.

G2: deletion is slightly observed on an image part or a non-image part, but there are no problems in image quality.

G3: deletion is observed on an image part or a non-image part and there is concern about practical use.

G4: deletion is clearly observed on an image part or a non-image part and there are problems in image quality.

Image Defects: Evaluation of Defects due to Cleaning Failure

A formation state of image defects due to color streaks caused by the passing from a cleaning blade is evaluated.

The acceptable levels are levels up to G2.

Evaluation Criteria

G1: no problems in image quality.

G2: color streaks are slightly observed on an image, but there are no problems in image quality.

G3: color streaks or image deletion are slightly observed on an image, but it is in the acceptable level.

G4: color streaks or image deletion are clearly observed on an image and there are obvious problems in image quality.

Overall Determination

The overall determination is performed from the evaluations described above.

A: results of all evaluations are G1 and there are no problems in image quality.

B: results of all evaluations are G2, but there is no concern about practical use.

C: one or more results of evaluations are G3 or subsequent levels.

TABLE 4

| | | Surface of photoreceptor | Half-tone | | |
|---|---|---|---|---|---|
| | | Visual observation grade of filming | Deletion of half-tone image part/non-image part | Color streaks due to cleaning failure | Overall determination |
| Examples | 1 | G1 | G1 | G1 | A |
| | 2 | G2 | G1 | G2 | B |
| | 3 | G1 | G1 | G2 | B |
| | 4 | G1 | G1 | G1 | A |
| | 5 | G1 | G1 | G2 | B |
| | 6 | G2 | G2 | G1 | B |
| | 7 | G2 | G2 | G2 | B |
| | 8 | G1 | G1 | G2 | B |
| | 9 | G2 | G2 | G1 | B |
| | 10 | G1 | G1 | G2 | B |
| | 11 | G1 | G2 | G1 | B |
| | 12 | G1 | G2 | G2 | B |
| | 13 | G2 | G1 | G2 | B |
| | 14 | G1 | G1 | G2 | B |
| | 15 | G2 | G2 | G2 | B |
| | 16 | G1 | G1 | G2 | B |
| | 17 | G2 | G2 | G2 | B |
| | 18 | G1 | G1 | G1 | A |
| | 19 | G1 | G1 | G2 | B |
| | 20 | G1 | G1 | G1 | A |
| | 21 | G1 | G1 | G1 | A |
| Comparative Examples | 1 | G2 | G2 | G3 | C |
| | 2 | G2 | G2 | G3 | C |
| | 3 | G2 | G3 | G4 | C |
| | 4 | G2 | G2 | G4 | C |
| | 5 | G4 | G4 | G4 | C |
| | 6 | G4 | G4 | G4 | C |
| | 7 | G4 | G4 | G3 | C |
| | 8 | G2 | G3 | G3 | C |
| | 9 | G3 | G4 | G4 | C |
| | 10 | G3 | G3 | G3 | C |

From the above results, it is found that, in the examples, when the same images are successively formed and then a half-tone image that is different from the image described above is formed, formation of image defects occurring on a boundary between an image part and a non-image part of the image successively formed is prevented, unlike in the case of the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles;

silica particles having an average particle diameter of 80 nm to 200 nm;

lubricant particles N which has negatively chargeable property, wherein the lubricant particles N are polytetrafluoroethylene particles; and lubricant particles P which has positively chargeable property, wherein the lubricant particles P are one of zinc stearate particles and zinc laurate particles, wherein a content (s) of the silica particles, a content (n) of the lubricant particles N, and a content (p) of the lubricant particles P satisfy relationships of the following Expression (1) and Expression (2):

$$0.002 \leq p/s \leq 0.2; \text{ and} \qquad \text{Expression (1):}$$

$$0.02 \leq n/s \leq 0.5. \qquad \text{Expression (2):}$$

2. The electrostatic charge image developing toner according to claim 1, wherein the silica particles are monodisperse spherical silica particles having an average circularity of 0.75 to 1.0.

3. The electrostatic charge image developing toner according to claim 1, wherein a proportion of the silica particles isolated from the toner particles is from 5% to 50%, a proportion of the lubricant particles N isolated from the toner particles is from 5% to 50%, and a proportion of the lubricant particles P isolated from the toner particles is from 5% to 50%.

4. The electrostatic charge image developing toner according to claim 1, which comprises the lubricant particles P in an amount of 0.001% by weight to 0.5% by weight with respect to the toner particles.

5. The electrostatic charge image developing toner according to claim 1, which comprises the lubricant N in an amount of 0.05% by weight to 0.5% by weight with respect to the toner particles.

6. The electrostatic charge image developing toner according to claim 1, which comprises the silica particles in an amount of 0.5% by weight to 3.0% by weight with respect to the toner particles.

7. The electrostatic charge image developing toner according to claim 1, wherein the silica particles are sol-gel silica particles.

8. The electrostatic charge image developing toner according to claim 1, wherein an average particle diameter of the lubricant particles P is from 0.1 μm to 50 μm.

9. The electrostatic charge image developing toner according to claim 1, wherein an average particle diameter of the lubricant particles N is from 100 nm to 1,000 nm.

10. The electrostatic charge image developing toner according to claim 1, wherein a volume average particle diameter (D50v) of the toner particles is from 4 μm to 8 μm.

11. The electrostatic charge image developing toner according to claim 1, wherein a shape factor SF1 of the toner particles is from 110 to 150.

12. The electrostatic charge image developing toner according to claim 1, wherein the toner particles include a polyester resin.

13. The electrostatic charge image developing toner according to claim 12, wherein a glass transition temperature (Tg) of the polyester resin is from 50° C. to 80° C.

14. The electrostatic charge image developing toner according to claim 12, wherein neopentyl glycol is included as a compositional monomer of the polyester resin.

15. An electrostatic charge image developer comprising:

the electrostatic charge image developing toner according to claim 1.

16. A toner cartridge comprising:

a container that contains the electrostatic charge image developing toner according to claim 1, wherein the toner cartridge is detachable from an image forming apparatus.

* * * * *